US006162156A

United States Patent [19]

Fujikawa et al.

[11] Patent Number: 6,162,156

[45] **Date of Patent: *Dec. 19, 2000**

[54] PACKAGING MACHINE

[75] Inventors: Yasuji Fujikawa; Takashi Arao; Michio Ueda, all of Tokushima, Japan

[73] Assignee: Shikoku Kakoki Co., Ltd., Tokushima, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/144,022

[22] Filed: Aug. 31, 1998

[30] Foreign Application Priority Data

Sep. 2, 1997 [JP] Japan ..... 9-236664

[51] Int. Cl.[7] ..... B31B 1/28

[52] U.S. Cl. ..... 493/165; 493/133; 493/452; 493/373; 493/467; 15/309.2

[58] Field of Search ..... 493/133, 164, 493/165, 452, 467, 480, 373; 53/141, 426; 15/309.2

[56] References Cited

U.S. PATENT DOCUMENTS

| | | | |
|---|---|---|---|
| 3,789,746 | 2/1974 | Martensson et al. | 493/165 |
| 4,715,847 | 12/1987 | Focke et al. | 493/373 |
| 4,776,830 | 10/1988 | Fujikawa et al. | 493/164 |
| 4,838,847 | 6/1989 | Kume et al. | 493/164 |
| 5,120,292 | 6/1992 | Ueda et al. | 493/164 |
| 5,533,955 | 7/1996 | Cann et al. | 493/373 |

FOREIGN PATENT DOCUMENTS

| | | |
|---|---|---|
| 0 253 027 | 1/1988 | European Pat. Off. . |
| 0 281 206 | 9/1988 | European Pat. Off. . |
| 2021898 | 7/1970 | France . |

*Primary Examiner*—Paul N. Dickson
*Assistant Examiner*—Matthew Luby
*Attorney, Agent, or Firm*—Armstrong, Westerman, Hattori, McLeland & Naughton

[57] ABSTRACT

A packaging machine comprises a rotor 22 having radial mandrels 21 each adapted to carry a tubular blank 11 of square to rectangular cross section as fitted therearound and arranged to successively stop at a plurality of processing stations I to VIII, a group of devices 23 to 28 arranged respectively at the required stations among the processing stations I to VIII for folding and closing a container bottom forming end portion 14 of the blank 11 as fitted around the mandrel 21, and an air suction nozzle 31 for collecting extraneous matter is disposed at a required location along a path of movement of the mandrel.

1 Claim, 4 Drawing Sheets

PACKAGING MACHINE

BACKGROUND OF THE INVENTION

The present invention relates to a packaging machine for preparing containers from blanks each folded flat so as to be unfoldable into a tube of square to rectangular cross section and filling milk, or like contents, into the containers.

Packaging machines are already known which comprise a rotor having radial mandrels each adapted to carry a tubular blank of square to rectangular cross section as fitted therearound and arranged to successively stop at a plurality of processing stations, and a group of devices arranged respectively at the required stations among the processing stations for folding and closing a container bottom forming end portion of the blank as fitted around the mandrel.

The packaging machine described produces extraneous matter, such as paper particles, when the devices perform the required packing operation on the blank. If ingressing into the container, the extraneous matter poses a problem from the viewpoint of sanitation, so that the mandrels and devices are periodically cleaned of the extraneous matter.

The cleaning work involves the likelihood that the worker will touch some mandrels or other components of the machine with his hand to contaminate the mandrels, etc. or, conversely, scatter the extraneous matter around the machine.

SUMMARY OF THE INVENTION

An object of the present invention is to provide a packaging machine so adapted that the extraneous matter, such as paper particles, produced from blanks can be reliably collected without the likelihood of contaminating mandrels and component devices or scattering the extraneous matter around the machine.

The present invention provides a packaging machine comprising a rotor having radial mandrels each adapted to carry a tubular blank of square to rectangular cross section as fitted therearound and arranged to successively stop at a plurality of processing stations, and a group of devices arranged respectively at the required stations among the processing stations for folding and closing a container bottom-forming end portion of the blank as fitted around the mandrel, the packaging machine being characterized in that an air suction nozzle for collecting extraneous matter is disposed at a required location along a path of movement of the mandrel.

With the packaging machine according to the invention, the air suction nozzle is so disposed as to draw in air at the required location along the path of movement of the mandrels, so that the extraneous matter, including paper particles and produced from blanks, is collected along with the air drawn into nozzle. Accordingly, the extraneous matter, such as paper particles, produced from blanks can be reliably collected without the likelihood that the extraneous matter will contaminate the mandrels or component devices or will be scattered around.

Preferably, the plurality of processing stations include a folding station and a bonding station, a container bottom folder being disposed at the folding station, a container bottom bonding device being disposed at the bonding station, a rail for holding the blank end portion folded being disposed at a required location from the folding station to the bonding station, the suction nozzle having suction openings opposed to the path of movement of the mandrels from the folding station to the bonding station.

The folder is brought into contact with the blank at the folding station, and the blank is brought into sliding contact with the rail for holding the blank end portion folded, so that extraneous matter is liable to be produced, especially at the folding station and around the holding rail, whereas the extraneous matter produced is collected efficiently by the suction nozzle.

Further preferably, the holding rail comprises a pair of rail members extending in the direction of movement of the mandrel and arranged side by side as spaced apart from each other, the bottom bonding device comprising a pressure member opposed to an outer end face of the mandrel as stopped at the bonding station, the suction openings including a first suction opening opposed to the path of movement of the mandrel from between the pair of rail members, and a second suction opening opposed to the path of movement of the mandrel from between the pressure member and a downstream end, with respect to the path of movement of the mandrel, of the holding rail.

Utilizing a dead space, the suction nozzle is disposed in close proximity to the path of movement of the mandrels.

DESCRIPTION OF THE PREFERRED EMBODIMENT

An embodiment of the invention will be described below with reference to the drawings.

Figure 4:
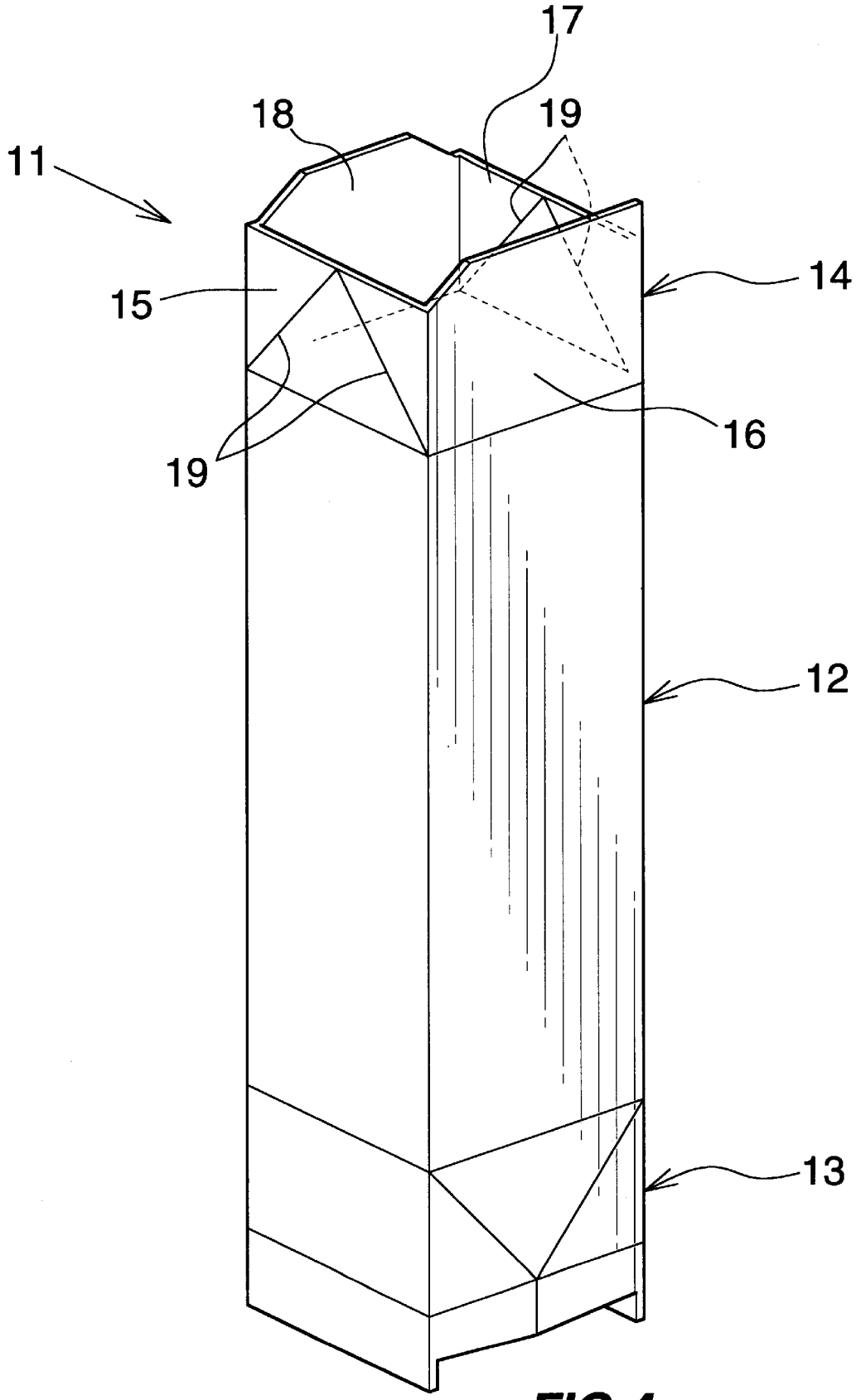
FIG. 4 is a perspective view of a blank for use with the packaging machine.

FIG. 4 shows a tubular blank 11 of square to rectangular cross section as turned upside down. The blank 11 is made of a paper-base laminate coated with polyethylene over the surface, and comprises a trunk forming portion 12 to be made into a trunk, a top forming end portion 13 to be made into a top, and a bottom forming end portion 14 to be made into a bottom.

Figure 2:
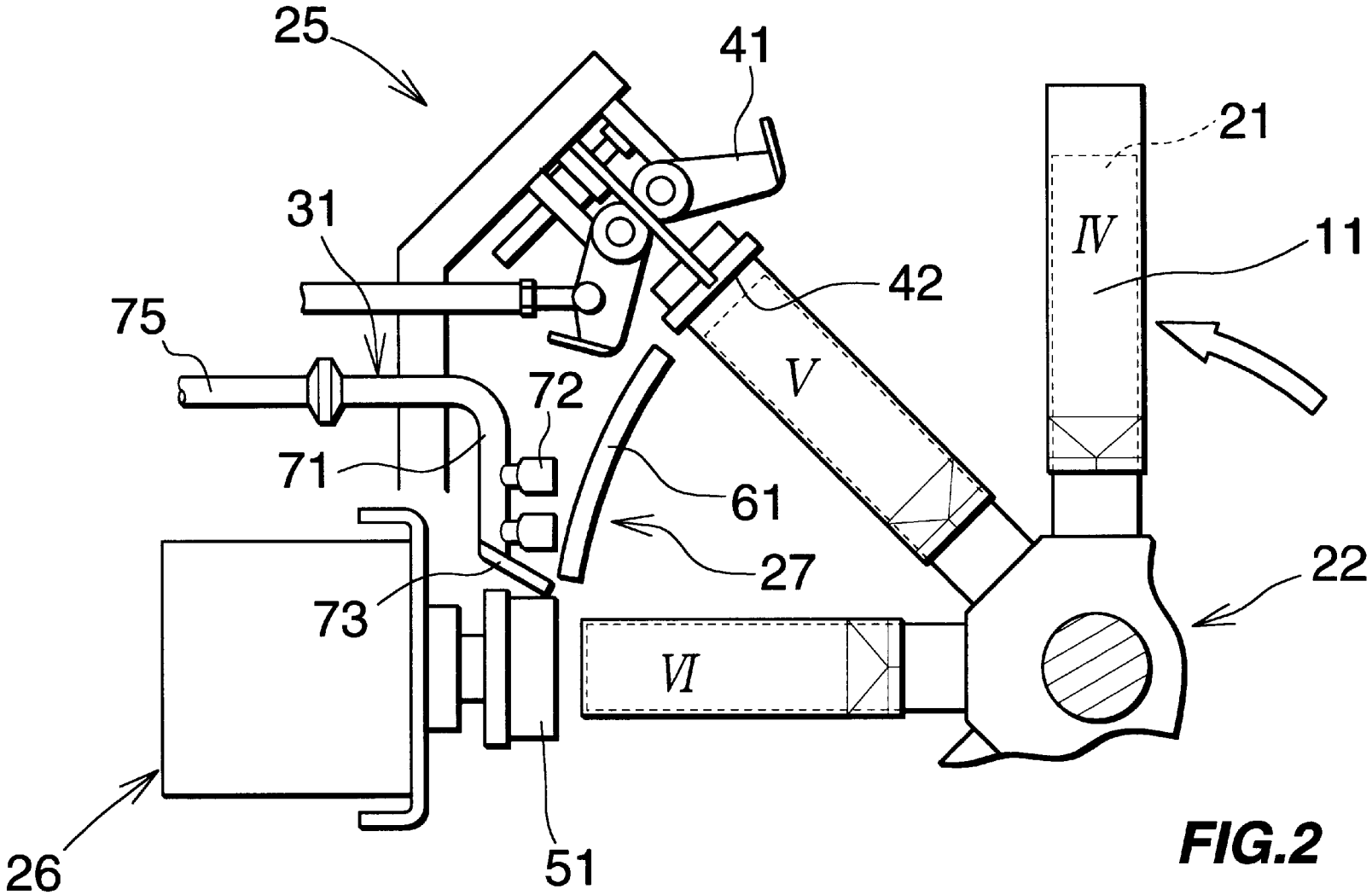
FIG. 2 is an enlarged fragmentary side elevation of FIG. 1.

The bottom forming end portion 14 comprises first to fourth rectangular bottom panels 15 to 18 which are joined to one another endlessly. The first and third bottom panels 15, 17 are each formed with an inverted V-shaped fold line 19. With reference to FIG. 2, the blank 11 is fitted around a mandrel 21 with the bottom forming end portion 14 projecting outward beyond the outer end of the mandrel 21. The first and third bottom panels 15, 17 are positioned orthogonal to the direction (indicated by an arrow in FIG. 2) of movement of the mandrel. The second and fourth bottom panels 16, 18 are positioned in parallel to the direction of movement of the mandrel.

Figure 1:
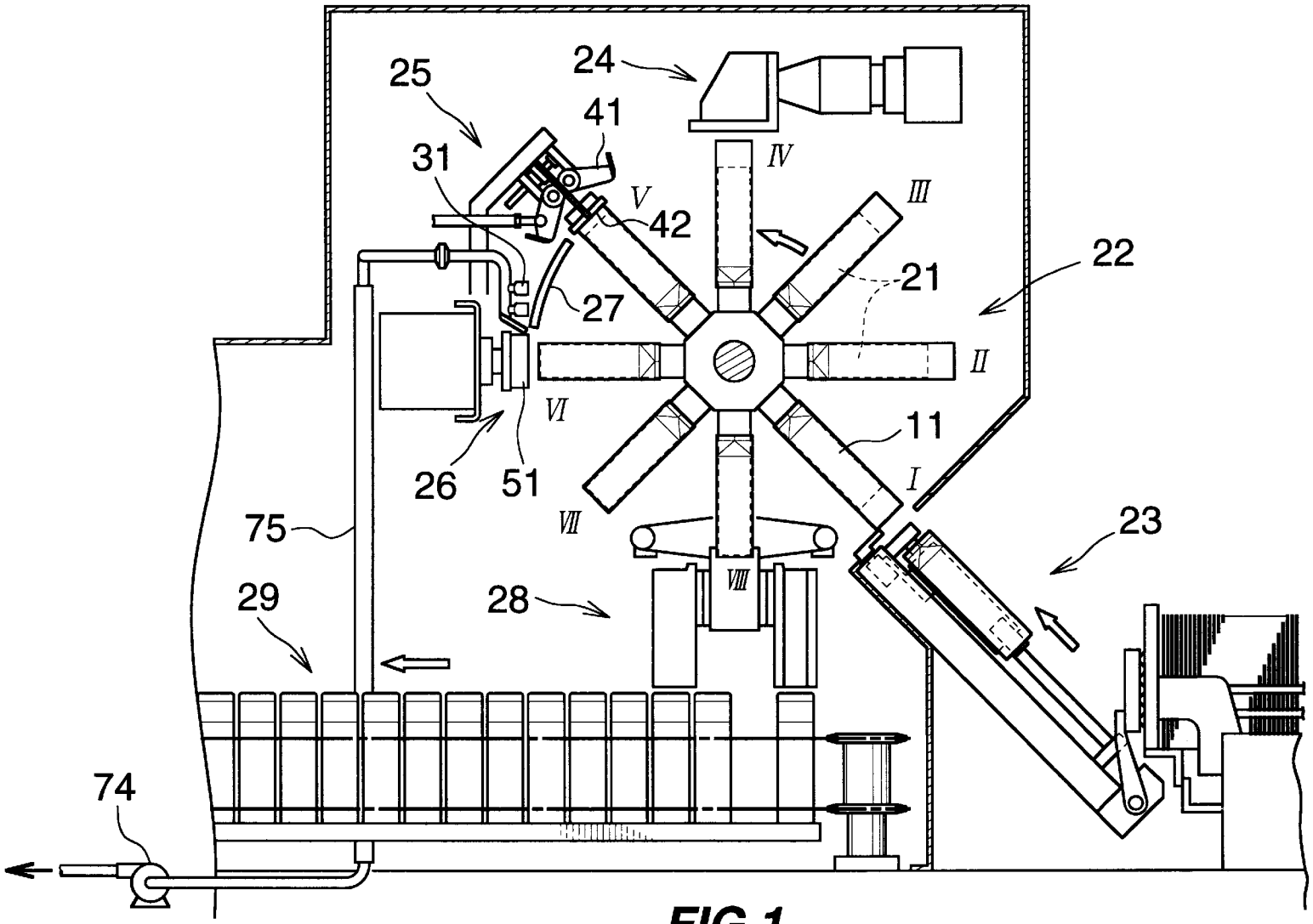
FIG. 1 is a side elevation of a packaging machine embodying the invention.

FIG. 1 shows a packaging machine, which comprises a rotor 22 having eight radial mandrels 21 and intermittently drivable so as to stop the mandrels successively at eight stations, i.e., first to eighth processing stations I to VIII, a blank feeder 23 disposed at the first processing station I for fitting the tubular blank 11 around the mandrel 21 with the bottom forming end portion 14 thereof projecting beyond the outer end of the mandrel 21, a bottom heater 24 disposed at the fourth processing station IV for applying hot air to the blank end portion 14, a bottom folder 25 positioned at the fifth processing station V for folding the blank end portion 14 flat, a bottom bonding device 26 positioned at the sixth processing station VI for bonding the folded end portion under pressure, a guide rail 27 extending from the fifth processing station V to the sixth processing station VI for guiding the blank end portion 14 folded by the folder 25 to the position of the bottom bonding device 26 so as to hold the end portion 14 folded, a container delivery device 28 disposed at the eighth processing station VIII for removing the blank 11 having a closed bottom from the mandrel 21, and a container transport conveyor 29 extending from the eighth processing station VIII as the starting end of a path of transport for receiving and transporting the blank 11 delivered from the mandrel.

The second, third and seventh processing stations II, III, VII are reserve stations.

While the blank 11, closed at its bottom, is being transported by the conveyor 29, contents are filled into the blank 11, and the blank 11 is thereafter closed at its top forming end portion 13 to provide a closed container.

An air suction nozzle 31 for collecting extraneous matter is disposed close to the rail 27 for holding the blank bottom end closed.

The bottom folder 25 has a pair of first folding members 41 openable and closable along the direction of movement of the mandrel and a pair of second folding members 42 openable and closable in directions perpendicular to the direction of movement of the mandrel.

The first and third bottom panels 15, 17 of the bottom forming end portion 14 are first folded inward by the first folding members 41, and the second and third bottom panels 16, 18 are then folded inward over the folded first and second bottom panels 15, 17 by the second folding members 42.

The bottom bonding device 26 has a pressure member 51 opposed to the outer end face of the mandrel 21 as halted at the sixth station VI and movable toward and away from the end face.

The pressure member 51 presses the folded blank end portion 14 against the outer end face of the mandrel 21, whereby the laps of the end portion 14 are bonded under pressure.

Figure 3:
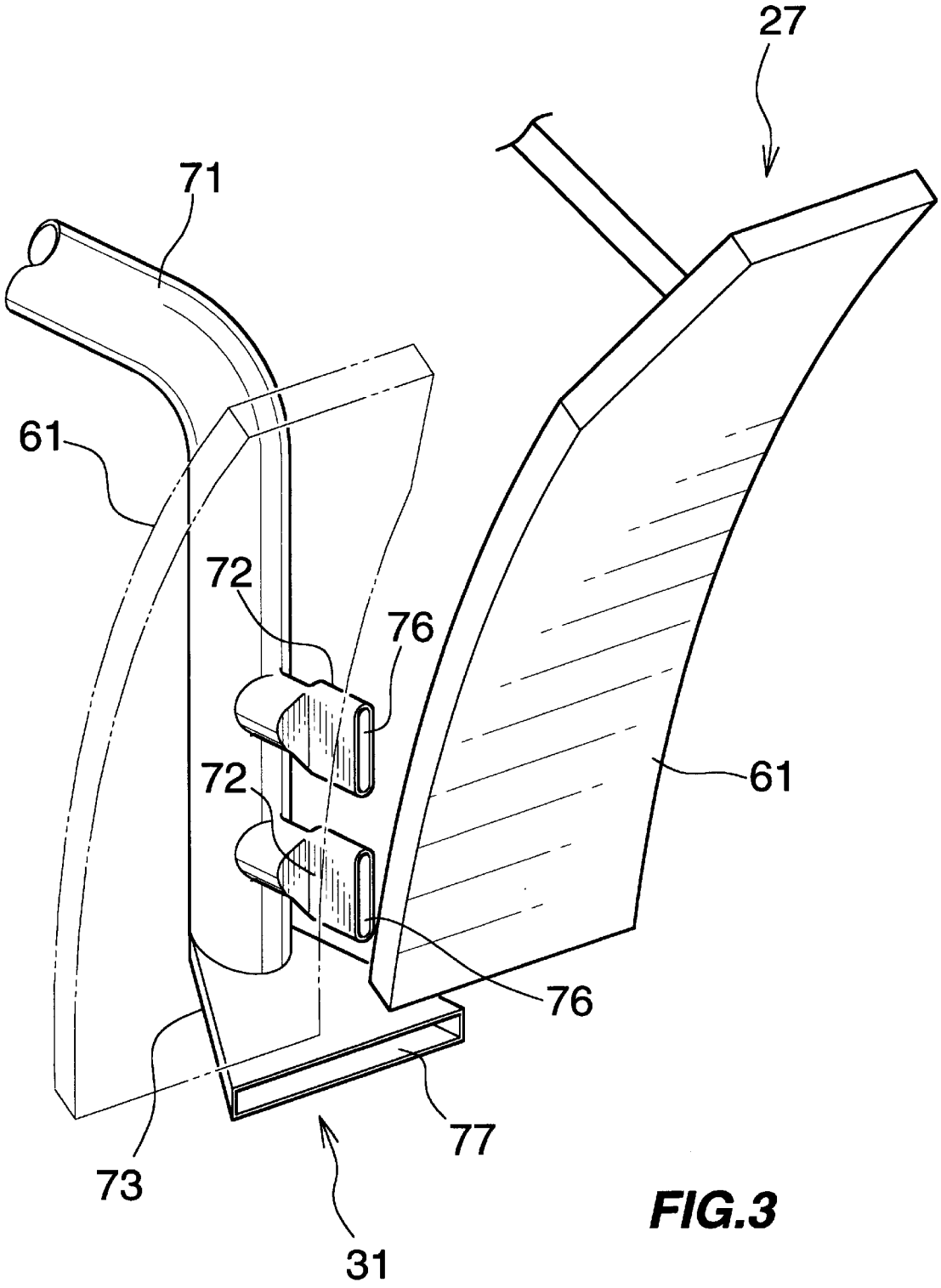
FIG. 3 is a perspective view of a guide rail and a 5 nozzle of the packaging machine.

As shown in greater detail in FIG. 3, the guide rail 27 has a pair of rail members 61. The rail members 61 are each in the form of a circular-arc plate extending along the path of movement of the mandrel between positions adjacent the pressure member 51 and the first and second folding members 41, 42,respectively. The rail members 61 are spaced apart from each other and face in opposition toward the outer end face of the mandrel 21 with a small spacing provided therebetween opposite which while the mandrel travels. A clearance is formed between the pressure member 51 and the lower ends of the rail members 61 which ends are positioned downstream with respect to the movement of the mandrel.

The folded end portion 14 of the blank 11 is held folded by moving in sliding contact with the guide rail 27.

The air suction nozzle 31 comprises a nozzle body 71 in the form of an inverted L-shaped pipe, two first opening members 72 provided on a vertical portion of the nozzle body 71, and a second opening member 73 provided at the lower end of the vertical portion of the nozzle body 71.

A suction pipe 75 extending from a blower 74 is connected to an open end of horizontal portion of the nozzle body 71 (FIG. 1).

The first opening members 72 each have a first suction opening 76 in the form of a vertically elongated circle. The second opening member 73 has a second suction opening 77 in the form of a horizontally elongated opening. Between the two rail members 61 of the guide rail 27, the two first suction openings 76 are opposed to the path of movement of the mandrel in close proximity thereto. Between the pressure member 51 and the two rail members 61, the second suction opening 77 is opposed to the path of movement of the mandrel in close proximity thereto.

The polyethylene layer over the surface of the blank is softened and melted with the hot air applied thereto by the bottom heater 24. When folded by the folder 25 and brought into sliding contact with the guide rail 27, the softened portion of the blank 11 produces waste particles of polyethylene and paper, which are drawn into the nozzle 31 along with air. This obviates the likelihood that the waste particles will scatter in the packaging work environment, keeping the environment clean.

The waste particles produced by the guide rail 27 are collected usually from the first opening members 72, whereas those remaining uncollected by the first opening members 72 move along the guide rail 27 and are likely to collect, for example, on the pressure member 51. This likelihood can be eliminated by the second opening member 73 disposed at the illustrated position. For the collection of extraneous matter such as paper particles, the suction nozzle may be connected to a cover so shaped as to cover the entire folder and not to interfere with the passage of the blank as fitted to the mandrel. In this case, there arises a need to use a blower 74 of increased capacity.

The present invention is applicable also to packaging machines which include a folder for folding the blank during the movement of mandrels as disclosed in JP-B No. 10244/1981 in place of the folder described.

What is claimed is:

1. A packaging machine including a rotor having radial mandrels each adapted to carry a tubular blank of square to rectangular cross section as fitted therearound and arranged to successively stop at a plurality of processing stations, and a group of devices arranged respectively at predetermined stations among the processing stations for folding and closing a container bottom forming end portion of the blank as fitted around the mandrel, the packaging machine further comprising an air suction nozzle for collecting extraneous matter disposed at a predetermined location along a path of movement of the mandrels, wherein the plurality of processing stations include a folding station and a bonding station, a container bottom folder being disposed at the folding station, a container bottom bonding device being disposed at the bonding station, a rail for holding the blank end portion folded being disposed at a location between the folding station and the bonding station, the bottom bonding device comprising a pressure member positioned opposite to an outer end face of the mandrels when each is stopped at the bonding station, the air suction nozzle having its suction opening directed upon the path of movement of the mandrels from between the downstream end of the holding rail and the pressure member of the bottom bonding device and a downstream end of the holding rail with respect to the path of movement of the mandrel, and wherein the holding rail for holding the blank end portion comprises a pair of spaced apart parallel rail members extending in the direction of movement of the mandrels the air suction nozzle further comprising a suction opening positioned upstream of said air suction nozzle between the holding rails and the bottom bonding device and directed upon path of movement of the mandrels from between the rail members.

* * * * *